US006608976B2

(12) United States Patent
Nishitani et al.

(10) Patent No.: US 6,608,976 B2
(45) Date of Patent: Aug. 19, 2003

(54) IMAGE HEATING APPARATUS

(75) Inventors: Hitoshi Nishitani, Ibaraki (JP); Naoki Nakamura, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/973,721

(22) Filed: Oct. 11, 2001

(65) Prior Publication Data

US 2002/0071700 A1 Jun. 13, 2002

(30) Foreign Application Priority Data

Oct. 13, 2000 (JP) ..... 2000-313976
Dec. 18, 2000 (JP) ..... 2000-383998

(51) Int. Cl.[7] ..... G03G 15/20
(52) U.S. Cl. ..... 399/69; 399/328
(58) Field of Search ..... 399/69, 328, 329, 399/330; 219/216; 374/185, 187, 208

(56) References Cited

U.S. PATENT DOCUMENTS 4,951,096 A * 8/1990 Derimiggio et al. ..... 399/69
5,148,226 A 9/1992 Setoriyama et al.
5,149,941 A 9/1992 Hirabayashi et al. ..... 219/216
5,281,793 A * 1/1994 Gavin et al. ..... 219/216
5,309,209 A * 5/1994 Huh ..... 399/69
5,832,354 A * 11/1998 Kouno et al. ..... 399/330
5,937,230 A * 8/1999 Iwase et al. ..... 399/69

FOREIGN PATENT DOCUMENTS

| | | |
|---|---|---|
| JP | 63-313182 | 12/1988 |
| JP | 4-55057 | 2/1992 |
| JP | 04-044077 | 2/1992 |

* cited by examiner

*Primary Examiner*—Sandra Brase
(74) *Attorney, Agent, or Firm*—Fitzpatrick, Cella, Harper & Scinto

(57) ABSTRACT

An image heating apparatus including a heater, a temperature detecting element for detecting a temperature of the heater, a supporting member for supporting the temperature detecting element, and a biasing member for biasing the supporting member toward the heater. The biasing member biases a surface of the supporting member opposite to the surface in which the temperature detecting element is provided.

10 Claims, 12 Drawing Sheets

IMAGE HEATING APPARATUS

BACKGROUND OF THE INVENTION

1. Field of the Invention

The present invention relates to an image heating apparatus which can be suitably used as a fixing device to be equipped particularly in an image forming apparatus, such as a copying machine, a laser printer or a facsimile machine, using an electrophotographic process.

2. Description of The Related Art

Conventional image forming apparatuses using the electrophotographic process have a construction such as shown in FIG. 4, for example.

Referring to FIG. 4, an image forming apparatus has a photosensitive drum 201 provided as an image bearing member, a charging roller 202, a laser exposure device 203, a reflection mirror 204, a development sleeve 205, toner 206, a toner container 207, a transfer roller 208, paper 209 provided as a recording medium, a cleaning blade 210, a waste toner container 211, a fixing device 212, a paper cassette 213, a feed roller 214, a separating pad 215, and a high voltage power supply 216.

The photosensitive drum 201 rotates in the direction indicated by an arrow and is electrostatically charged uniformly by the charging roller 202 electrified by the high voltage power supply 216. Laser beam emitted from the laser exposure device 203 is reflected by the reflection mirror 204 to be irradiated upon the photosensitive drum, thereby forming an electrostatic latent image on the photosensitive drum 201. The toner container 207 is filled with the toner 206. With the rotation of the development sleeve 205, a suitable amount of toner 206 is charged and supplied to the surface of the photosensitive drum 201. The toner on the surface of the development sleeve 205 is attached to the electrostatic latent image on the photosensitive drum 201. The latent image is thereby developed and visualized as a toner image.

On the other hand, the feed roller 214 feeds recording materials as the recording medium one by one from the paper cassette 213 at a predetermined suitable timing. The separating pad 215 is placed in contact with the feed roller 214. The friction coefficient, the contact angle and the configuration of the surface of the separating pad 215 are adjusted so as to feed only one recording material at a time.

The visualized toner image on the photosensitive drum is transferred onto the recording material by the transfer roller 208. Transfer residual toner remained on the photosensitive drum without being transferred is collected in the waste toner container 211 by the cleaning blade 210. The photosensitive drum the surface of which has been cleaned is successively used in the next image forming processing cycle. Also, the recording material 209 on which the toner image is borne is heated and pressurized by the fixing device 212 to permanently fix the toner image thereon.

As the fixing device 212, a film heating type fixing device such as the one disclosed in Japanese Patent Application Laid-open Nos. 63-313182, 4-44057, or 4-44077 is conventionally used, which uses a heater having heating resistor elements formed by patterning on a ceramic substrate. The heater is energized to generate heat, by which an object to be heated is heated through a thin film.

FIG. 5 shows a cross section of an example of such a film fixing device.

Referring to FIG. 5, a heater 8 has heating resistor elements 8*a* formed on a ceramic substrate extending in an axial direction. The heater 8 has its front surface coated with a glass layer 8*b*, which is formed as a protective layer. A temperature detecting device 107 is mounted on the back surface of the heater 8 to detect the temperature of the same.

The heating resistor elements 8*a* are energized by an unillustrated power supply to generate heat. A central processing unit (CPU) controls the amount of energization power by driving a triac so that the temperature detected by a temperature detecting element 1 of the temperature detecting device 107 is kept constant. A fixation film 101 is a sleeve-shaped heat-resistant film of a three-layer structure. The innermost layer is a base layer through which mechanical characteristics such as torsional strength and smoothness of the fixation film 101 are controlled, and which is made of a resin such as polyimide, polyamide-imide, polyetheretherketone (PEEK), polyether sulfone (PES), or polyphenylene sulfide (PPS). An electroconductive primer layer formed of a material in which electroconductive particles such as carbon black particles are dispersed is formed on the base layer. This primer layer has the function as an adhesive for bonding a third layer and the base layer. The outermost layer, i.e., a top layer, is designed so as to optimize the resistance value and film thickness for the purpose of preventing occurrence of various image defects.

A heater holding member 9 supports the heater 8 and is formed of a heat-resistant resin such as PPS or a liquid crystal polymer. The heater holding member 9 also functions as a guide member for enabling the fixation film 101 to rotate smoothly. A fixation stay 106 made of a metal such as iron or aluminum has the function of suppressing deformation due to creep in the heater supporting member to increase the rigidity of the heater supporting member.

A pressure roller 104 has a core metal 104*a* made of aluminum, cast iron or the like, and a heat-resistant elastic member 104*b* made of silicon rubber or the like, the elastic member 104*b* covering the core metal 104*a*. The surface of the pressure roller 104 is coated with a fluororesin such as perfluoroalkoxy (PFA), polytetrafluoroethylene (PTFE), and fluorinated ethylene propylene (FEP) having mold releasing ability in use with toner.

The pressure roller 104 contacts the heater 8 while being pressed against the same with the fixation film 101 interposed therebetween. A fixation nip N is formed by the pressure-contact portions of the pressure roller 104 and the fixation film 101. The core metal 104*a* of the pressure roller 104 receives a rotating drive force, and the fixation film 101 is driven through the fixation nip to rotate. A recording material P on which toner T is borne is transported by the transfer roller and the photosensitive drum (both not shown) and is guided by a fixation inlet guide 105 to enter the fixation nip. Toner T on the recording material is pressed and heated on the recording material, and the toner resin is thereby softened and caused to adhere to the recording material to be permanently fixed.

The thus-arranged film heating type of fixing device can use a heater of a small heat capacity and is therefore capable of reducing a wait time (achieving a quick start) in comparison with conventional thermal roller type fixing devices. Since the film heating type fixing device is capable of the quick start, it eliminates the need for preheating during a non-printing period to enable the image forming apparatus to be designed to totally achieve an energy saving effect.

FIGS. 6A, 6B, 6C, and 6D show an example of the conventional fixing device to which a conventional temperature detecting device is attached. FIG. 6A is a plan view, FIG. 6B is a diagram showing the temperature detecting device in a free state, FIG. 6C is a cross-sectional view taken along the line VIC—VIC of FIG. 6A, and FIG. 6D is a cross-sectional view taken along the line VID—VID of FIG. 6C.

Referring to FIG. 6B, the conventional temperature detecting device has a heat-resistant elastic member 2 having a lower surface in which a temperature detecting element 1 is provided. The elastic member 2 is mounted on a temperature detecting element holding member 33 by being fitted to a temperature detecting element holding surface 33*a*. The temperature detecting element holding member 33 is attached to a positioning member 34 by plate springs 35*a* and 35*b* electrically insulated from each other and capable of also serving as leads for the temperature detecting element 1.

An elongated positioning hole 34*a* and a circular positioning hole 34*b* are formed in the positioning member 34 at front and rear positions. A harness 7 connected to the plate springs 35*a* and 35*b* is extended from the positioning member 34 to be connected to the CPU shown in FIG. 5.

A heater holding member 39 has positioning projections 39*a* and 39*b* formed integrally with its main portion. The positioning projections 39*a* and 39*b* are fitted in the positioning holes 34*a* and 34*b* of the positioning member 34. A hole 39*c* is formed in the heater holding member 39. The temperature detecting element 1 can be brought into contact with the ceramic substrate of the heater 8 exposed in the hole 39*c*.

When the temperature detecting device is in an unrestrained state, the plate springs 35*a* and 35*b* are bent at a intermediate position so that the temperature detecting element holding portion 33 is in a downwardly-facing position, as shown in FIG. 6B. When the positioning member 34 is mounted on the heater holding member 39, the plate springs 35*a* and 35*b* are elastically deformed to press the contact surfaces of the temperature detecting element 1 and the heater 8 against each other.

Also, by fitting of the positioning holes 34*a* and 34*b* and the projections 9*a* and 9*b*, the position of the positioning member 34 in the radial direction is determined. The position of the positioning member 34 in the thrust direction is fixed and maintained by a fixing member (not shown).

As shown in FIG. 6C, the temperature detecting device is positioned relative to the heater holding member 39 and the heater 8 by the positioning member 34, and is connected to the temperature detecting element holding portion 34 by the plate springs 35*a* and 35*b*. The desired contact pressure between the temperature detecting element and the heater is maintained by the bending stress in the plate springs 35*a* and 35*b*.

FIG. 7 is a graph schematically showing the relationship between the contact pressure and the detected temperature. The abscissa represents the contact pressure and the ordinate represents the output of the temperature detecting element. The curve in the graph was formed by plotting changes in output with respect to changes in contact pressure when the temperature of the heater was constant.

The temperature detecting device has such a characteristic that the detection result changes when the contact pressure changes, as shown in FIG. 7. In practical use of the temperature detecting device, therefore, a usable range is set as indicated by a portion of the curve having a small gradient in the graph. The gradient is not equal to or sufficiently close to zero. Under these circumstances, it is important, in designing the temperature detection system, to stabilize the contact pressure in order to achieve more accurate temperature detection, improvements in response speed and optimization of temperature control.

The conventional temperature detecting device and the heat fixing device using the temperature detecting device, however, have problems described below.

First, there is a problem of instability of each of the surface pressure of the contact surfaces and the pressure balance between the contact surfaces. If the bent shape of the plate springs varies due to variations of the plate springs due to some factors in manufacture of the plate springs, the stability of the contact surfaces tends to become lower. There is a possibility of failure to apply the desired pressure in some place where the temperature detecting element contacts the heater, even if the applied pressure is constant. This leads to a reduction in temperature detection accuracy and is regarded as an important consideration.

Second, the accuracy of positioning on the heater cannot be stabilized. Since in the conventional temperature detecting device the positioning member and the temperature detecting element holding member are provided separately from each other and connected by plate springs, the stability of the accuracy of relative positioning of the heater and the temperature detecting element tends to become lower if the sizes of the holding member and the positioning member vary due to variations of the temperature detecting device due to some factors in manufacture of the device. Since the heater itself has a temperature distribution, this tendency leads to a reduction in temperature detection accuracy and is regarded as an important consideration.

Third, there is a problem of the through hole being enlarged. Since in the conventional temperature detecting device the positioning member and the temperature detecting element holding member are provided separately from each other and connected by plate springs, there is a need to sufficiently enlarge the through hole 39*c* relative to the size of the temperature detecting element holding member in order to absorb variations of the temperature detecting device due to some factors in manufacture of the device. Therefore the region where the heater contacts neither the heater holding member nor the temperature detecting device tends to become larger. Heat is not sufficiently dissipated from this non-contact portion, so that the temperature of the heater becomes extraordinarily higher than the ambient temperature. Therefore the increase in size of the non-contact portion leads to nonuniformity of fixation heating and thermal stress damaging the heater, and this phenomenon is an important consideration.

Also, FIGS. 8A, 8B, 8C, and 8D show another example of the conventional temperature detecting means. FIG. 8A is a plan view, and FIG. 8B is a front view in a free state.

The temperature detecting means includes a temperature detecting element (e.g., a thermistor) 1*a*, leads 1*b* for supplying a current to the temperature detecting element 1*a*, jacketed leads 2, metallic terminals 2*a* attached in a caulking manner to one ends of the jacketed leads 2, first and second conductors 33, first welded portions 33*a* of the conductors 33 welded to the leads 1*b* from the temperature detecting element, second welded portions 33*b* of the conductors 33 welded to the metallic terminals 2*a* attached to the jacketed leads 2, a temperature detecting means main body 34*a* formed of a heat-resistant resin by insert molding inserting the first and second conductors 33, a temperature detecting means fixing portion 34*b* formed of a heat-resistant resin by insert molding inserting the first and second conductors 33, a heat-resistant elastic member 5, and a heat-resistant cladding 6 provided for the purpose of ensuring an electrical withstand voltage and protecting the temperature detecting element.

The heat-resistant elastic member 5 is placed along a lower surface of the temperature detecting means main body 34*a*. The temperature detecting element 1*a* is positioned substantially at a center of the lower surface of the heat-resistant elastic member 5. The heat-resistant cladding 6 is formed so as to cover the entire lower surface of the heat-resistant elastic member 5 along which the temperature detecting element 1*a* is placed. That is, the heat-resistant elastic member 5 is provided between the temperature detecting element 1*a* and the temperature detecting means main body 34*a*, and the heat-resistant cladding 6 protects the temperature detecting element 1*a* and the heat-resistant elastic member 5.

Each of the first and second conductors 33 is formed of an electroconductive plate spring member and is bent into an elbow-like shape between the temperature detecting means main body 34*a* and the temperature detecting means fixing portion 34*b*, as shown in FIG. 8B. In an unrestrained (free) state, therefore, the temperature detecting means has the first and second conductors 33 bent into an elbow-like shape between the temperature detecting means main body 34*a* and the temperature detecting means fixing portion 34*b*, as shown in FIG. 8B.

In the temperature detecting means, the temperature detecting element 1*a* and the jacketed leads 2 are electrically connected to each other by the leads 1*b* of the temperature detecting element 1*a*, the first welded portions 33*a* of the conductors 33, the conductors 33, the second welded portions 33*b* of the conductors 33, and the metallic terminals 2*a* attached to the jacketed leads 2.

FIGS. 8C and 8D are a front view and a side view, respectively, of the temperature detecting means attached to a heater holding member. The heater designated by the reference numeral 8 is placed along a lower surface of the heater holding member designated by the reference numeral 9. In this example, the heater 8 and the heater holding member 9 are a ceramic heater and a member for holding the heater in a film heating type of heat fixing device. A through hole 9*a* is formed in the heater holding member 9. Part of the back surface of the heater 8 placed along the lower surface of the heater holding member 9 is exposed in the inner surface (opposite from the heater placement side) of the heater holding member 9 through the through hole 9*a*.

The temperature detecting means is placed along the inner surface of the heater holding member 9, the temperature detecting means main body 34*a* being positioned in correspondence with the through hole 9*a* of the heater holding member 9, the lower surface of the main body 34*a* (in which the temperature detecting element 1*a* is provided) facing downward Also, the first and second conductors 33 that are elbowed are warped in an extending direction against the force of their resilience. In this state, the temperature detecting means fixing portion 34*b* is fixed to the heater holding member 9. When the temperature detecting means is placed and fixed in this manner, the lower surface of the temperature detecting means main body 34*a* is maintained in contact with the back surface of the heater 8 in the through hole 9*a* of the heater holding member 9 by being pressed against the back surface of the heater 8 by the returning force of the resilience of the first and second conductors 33.

The jacketed leads 2 are connected to a temperature control circuit (not shown). The above-described temperature detecting means detects the temperature of the heater 8 as an amount of electricity by the temperature detecting element 1*a* and feeds back the amount of electricity to the temperature control circuit. The temperature control circuit controls the electric power supplied to the heater 8 according to the amount of electricity fed back as temperature detection information so that the temperature of the heater 8 is maintained at a predetermined point, thus controlling the temperature of the heater 8.

A primary object of use of the conductors 33 in the temperature detecting means is to enable a plate welding processing and an assembly process to be performed more easily. Electrical connections are made between the leads 1*b* and the jacketed leads 2 by using the conductors 33 as described above because operations for connecting the thin leads 1*b* of the temperature detecting element la and the metallic terminals 2*a* of the jacketed leads 2 directly by direct caulking or welding and for attaching the connected leads and terminals to the temperature detecting means main body 34*a* are difficult to perform in the case of mass production.

A secondary object of use of the conductors 33 is to use the conductors 33 as plate springs. That is, in the temperature detecting means in an unrestrained state, as described above, the first and second conductors 33 are bent into an elbow-like shape between the temperature detecting means main body 34*a* and the temperature detecting means fixing portion 34*b* as shown in FIG. 8B. When the thus-arranged temperature detecting means is mounted on the heater holding member 9, the conductors 33 are elastically deformed as plate springs as shown in FIG. 8C, thereby pressing the contact surfaces of the temperature detecting means 34*a* and the heater 8 against each other.

Also, the conventional temperature detecting element attached by welding after insert molding of the conductors by considering mass-producibility. To facilitate the welding, the conductors, the terminals and the leads are formed so as to have welded portions in correspondence with the two terminals of the temperature detecting element.

The temperature detecting means shown in FIGS. 8A to 8D, however, has problems described below.

1) The first problem is that the amount of heat dissipated from the conductors 33 is so large due to the increased area of the portions of the conductors 33 exposed outside that the temperature detection response is considerably low.

FIG. 9 is a graph showing the relationship between the temperature of the heater and the temperature detected by the conventional temperature detecting means. The abscissa represents the time, and the ordinate represents the actual temperature of the heater and the detected temperature. As shown in FIG. 9, the time delay in response of temperature detection by the conventional temperature detecting means is large and the temperature control cannot be optimized which is a problem. A high-speed-response temperature detecting means having a reduced time delay, such as shown in FIG. 9, is ideal for the detection system.

2) The second problem is that the possibility of damage to the heat fixing means is increased when a malfunction occurs in the electrical system.

If the time delay in temperature detection is large, there is a risk of the heat fixing device being damaged when an abnormal voltage is applied to the heater due to a malfunction in the electrical system, for example. That is, stopping energization of the heater by detecting its abnormal steep temperature rise may be delayed and the heat fixing device may be damaged before energization is stopped by detecting the abnormality.

Therefore, if the temperature detection response speed is low, the possibility of avoidance of a risk when abnormality occurs is reduced and the safety of the device cannot be ensured.

3) The third problem is that the surface pressure of the contact surfaces and the pressure balance between the contact surfaces are unstable.

Since part of each conductor is used as a plate spring, the stability of the contact surfaces tends to become lower if the bent shape varies depending on some factors in the manufacturing process, and there is a possibility of failure to apply the desired pressure in some place where the temperature detecting element contacts the heater, even if the applied pressure is constant. This leads to a reduction in temperature detection accuracy and nonuniformity of fixation in the heat fixing device and is regarded as an important consideration.

SUMMARY OF THE INVENTION

In view of the above-described problems, an object of the present invention is to provide an image heating apparatus in which a temperature detecting element is maintained in contact with a heater under suitable pressure.

Another object of the present invention is to provide an image heating apparatus having improved temperature detection accuracy.

Further, another object of the present invention is to provide an image heating apparatus comprising a heater, a temperature detecting element for detecting a temperature of the heater, a supporting member for supporting the temperature detecting element, and a biasing member for biasing the supporting member toward the heater, the biasing member biasing a surface of the supporting member opposite to the surface in which the temperature detecting element is provided.

These and other objects and features of the present invention will become apparent from the following detailed description of embodiments of the invention in conjunction with the accompanying drawings.

BRIEF DESCRIPTION OF THE DRAWINGS

FIG. 1A is a plan view;

FIG. 3A is a plan view;

FIG. 3B is a cross-sectional view taken along the line IIIB—IIIB of FIG. 3A;

FIG. 3C is a cross-sectional view taken along the line IIIC—IIIC of FIG. 3B;

FIG. 6A is a plan view;

FIG. 6B is a diagram showing the temperature detecting device in a free state:

FIG. 6C is a cross-sectional view taken along the line VIC—VIC of FIG. 6A:

FIG. 6D is a cross-sectional view taken along the line VID—VID of FIG. 6C;

DESCRIPTION OF THE PREFERRED EMBODIMENTS

First Embodiment

Figure 1A:
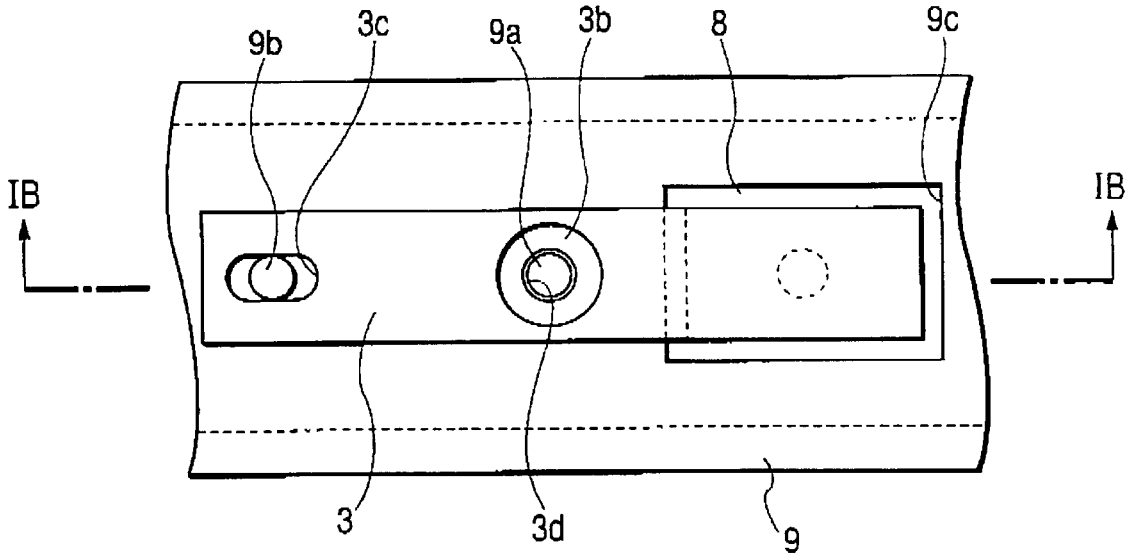
FIGS. 1A. 1B, and 1C show a temperature detecting device for a heat fixing device in a first embodiment of the present invention.
Figure 1B:
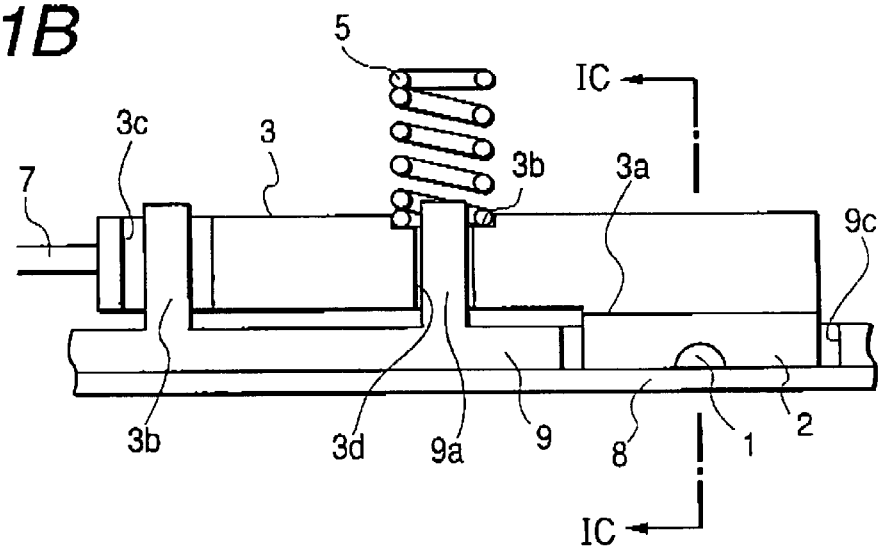
FIG. 1B is a cross-sectional view taken along the line IB—IB of FIG. 1A.
Figure 1C:
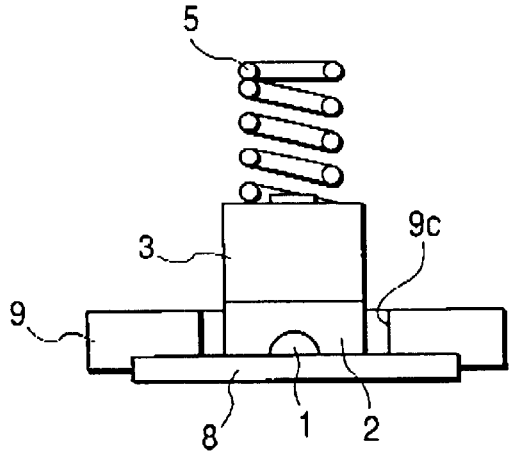
FIG. 1C is a cross-sectional view taken along the line IC—IC of FIG. 1B.
Figure 4:
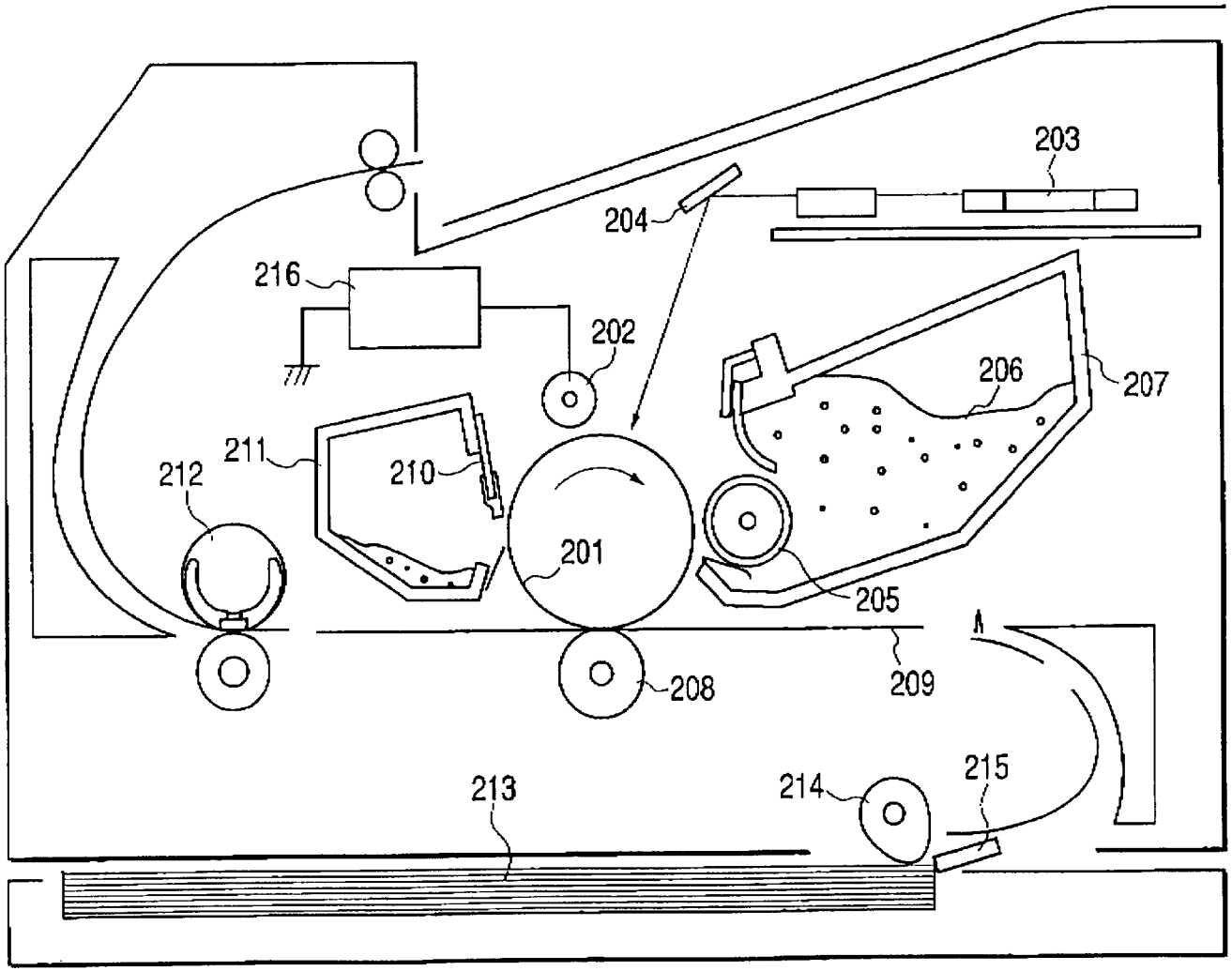
FIG. 4 is a schematic cross-sectional view of an image forming apparatus to which the present invention can be applied.
Figure 5:
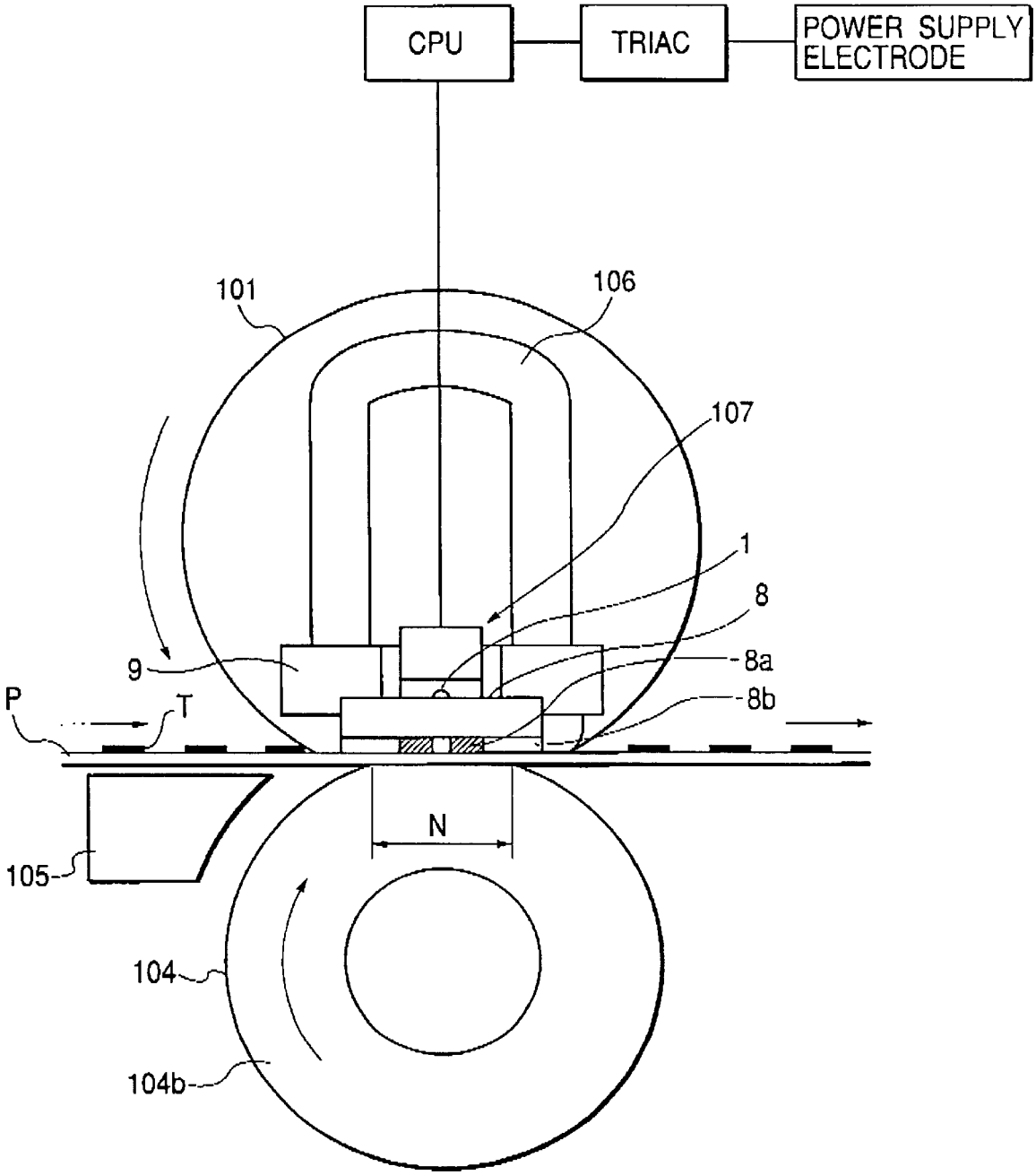
FIG. 5 is a schematic cross-sectional view of a heat fixing device to which the present invention can be applied.
Figure 6A:
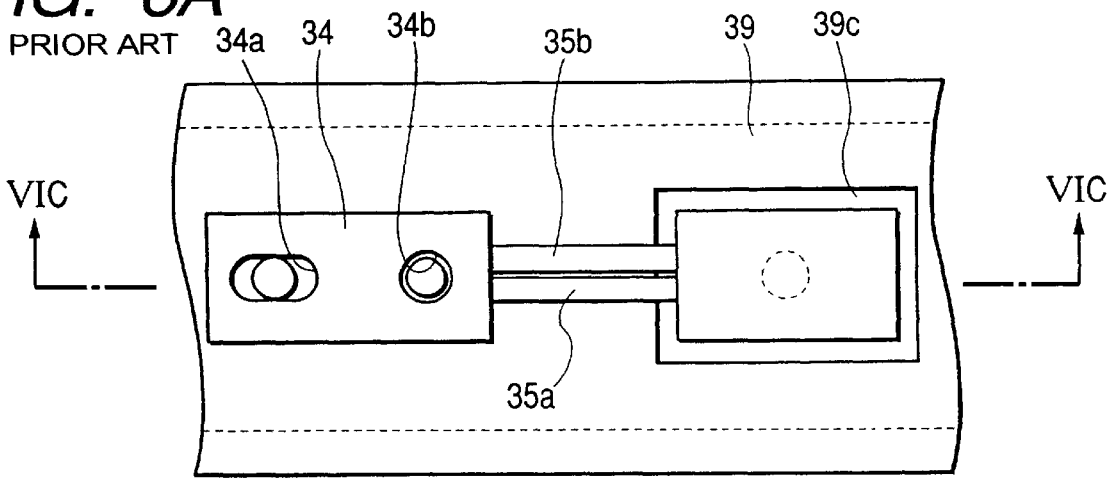
FIG. 6A PRIOR ART
FIGS. 6A, 6B, 6C, and 6D show a temperature detecting device in a conventional heat fixing device.
Figure 6B:
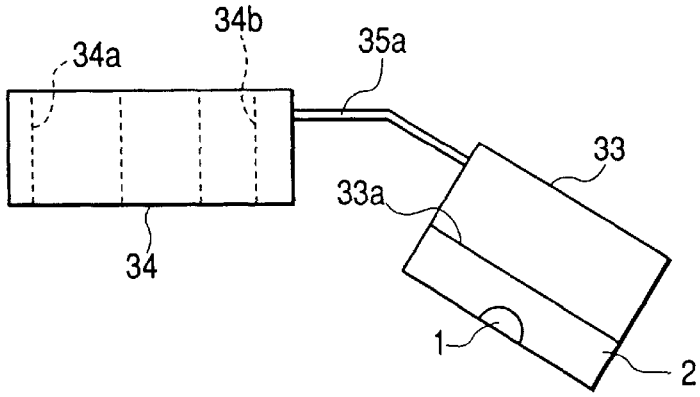
FIG. 6B PRIOR ART
Figure 6C:
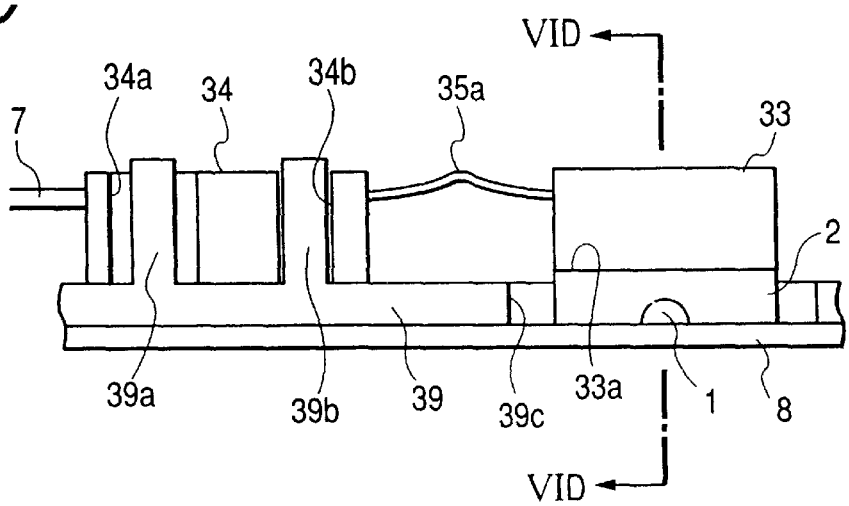
FIG. 6C PRIOR ART
Figure 6D:
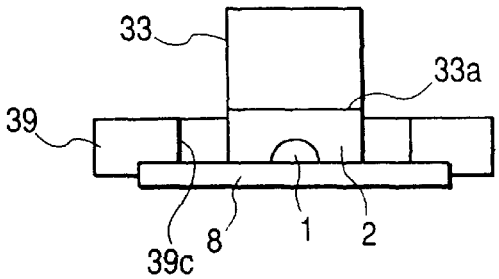
FIG. 6D PRIOR ART
Figure 7:
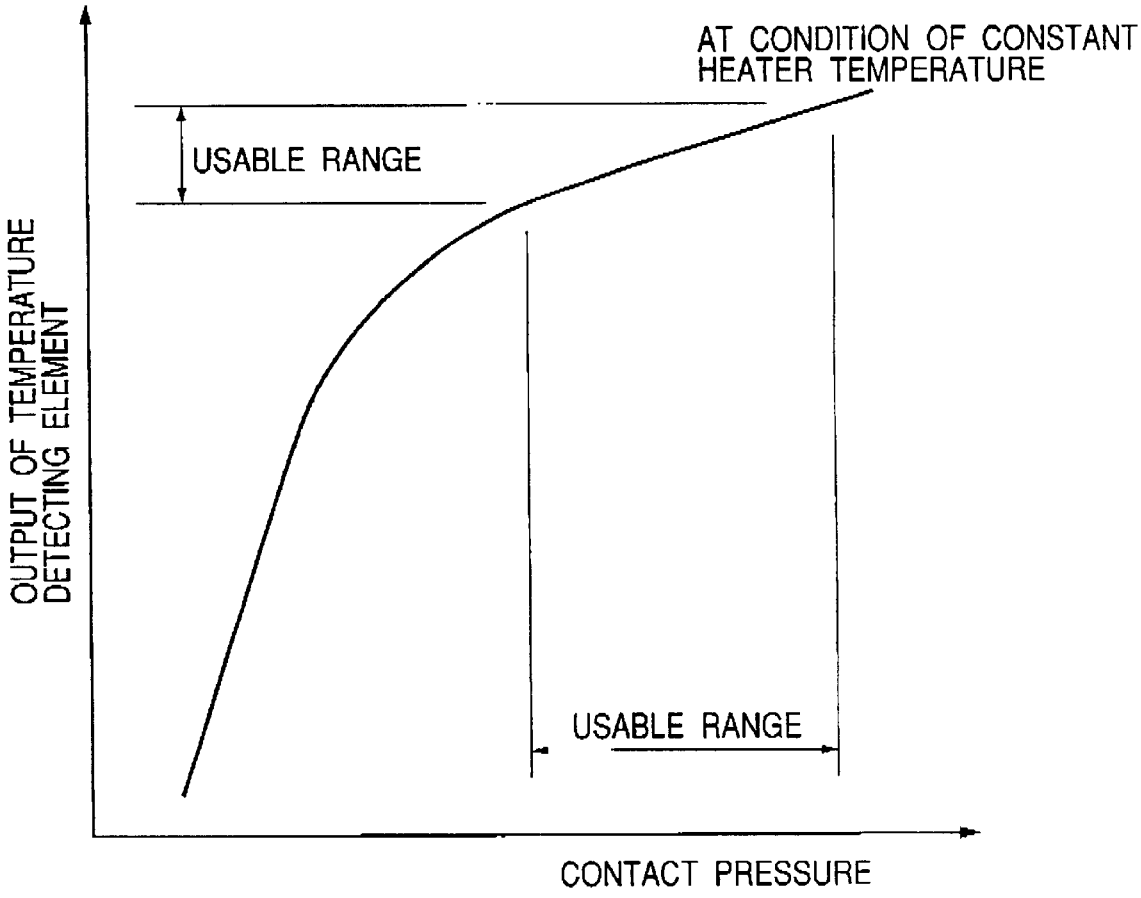
FIG. 7 is a characteristic diagram showing the relationship between the contact pressure and the output of the temperature detecting device.
Figure 8A:
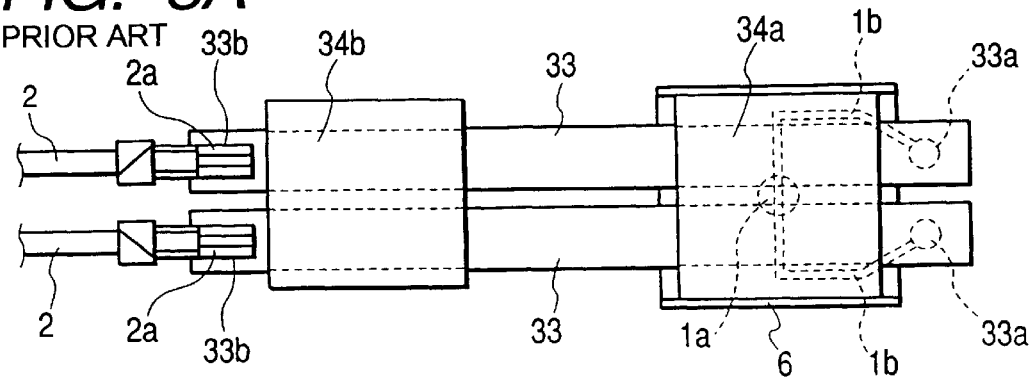
FIG. 8A PRIOR ART
FIGS. 8A, 8B, 8C, and 8D are diagrams showing another conventional temperature detecting device.
Figure 8B:
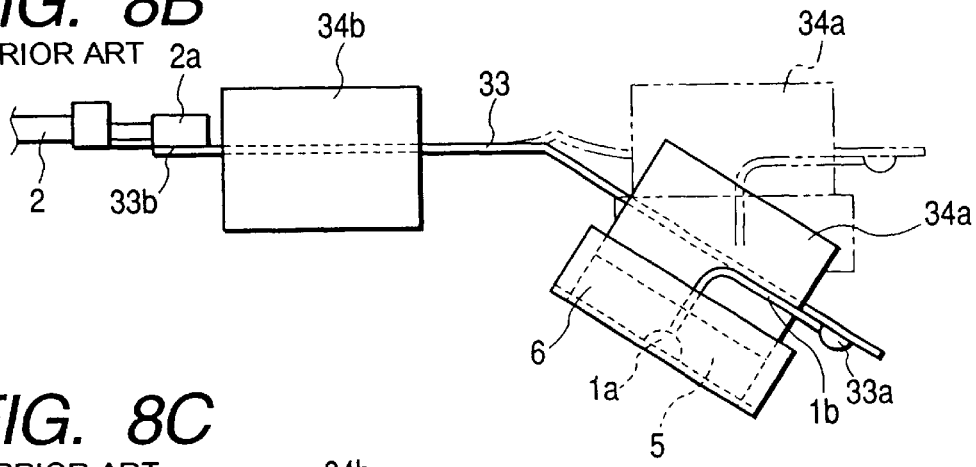
FIG. 8B PRIOR ART
Figure 8C:
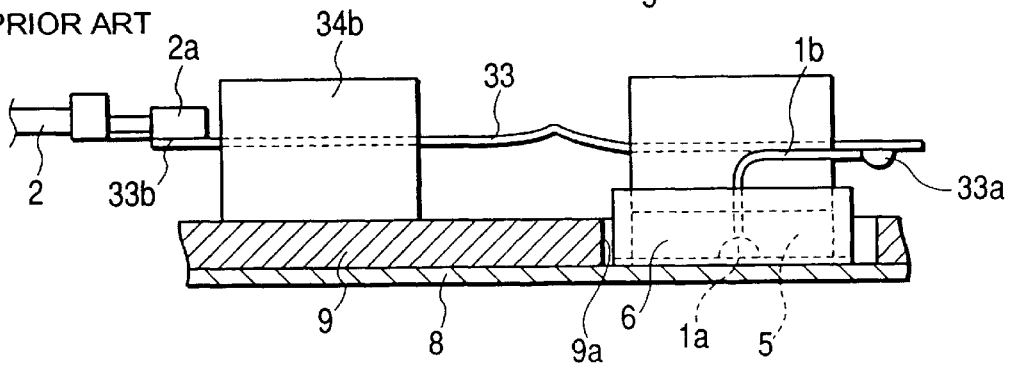
FIG. 8C PRIOR ART
Figure 8D:
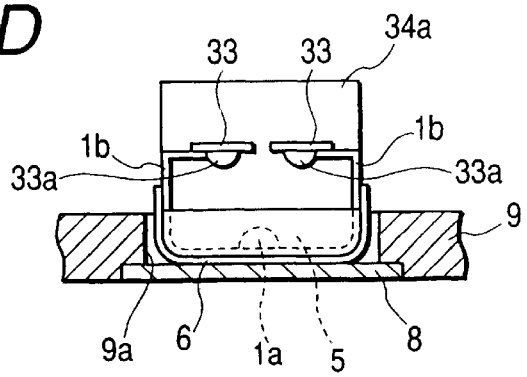
FIG. 8D PRIOR ART

FIGS. 1A, 1B, and 1C show a first embodiment of the present invention. Each of embodiments of the present invention described below can be applied to an image heating apparatus such as shown in FIG. 5 and to an image forming apparatus such as shown in FIG. 4.

FIGS. 1A, 1B, and 1C are diagrams showing a heat fixing device in which a temperature detecting device is attached to a heater holding member. FIG. 1A is a plan view, FIG. 1B is a cross-sectional view taken along the line IB—IB of FIG. 1A, and FIG. 1C is a cross-sectional view taken along the line IC—IC of FIG. 1B.

Referring to FIG. 1B, the temperature detecting device has a heat-resistant elastic member 2 having a lower surface in which a temperature detecting element 1 is provided. The heat-resistant elastic member 2 is attached to a temperature detecting element holding surface 3*a* provided on one end of a temperature detecting element holding member 3. A circular positioning hole 3*d* and an elongated positioning hole 3*c* are formed in an intermediate portion and in a portion at the other end, respectively, of the temperature detecting element holding member 3. A spring receiving surface 3*b* for receiving a lower end portion of a compression spring 5 is formed around the upper end opening of the positioning hole 3*d*. A harness 7 connected to the temperature detecting element 1 is extended outward from the other end of the temperature detecting element holding member 3.

A heater holding member 9 has positioning projections 9*a* and 9*b* formed therein to be fitted in the positioning holes 3*d* and 3*c* of the temperature detecting element holding member 3. When these projections are fitted in the positioning holes, the temperature detecting element 1 is brought into contact with the heater 8 by the heat-resistant elastic member 2 being fitted in a through hole 9*c* which is formed in the heater holding member 9, and in which the heater 8 is exposed. The compression spring 5 is not shown in FIG. 1A.

The positions of the positioning projections of the temperature detecting device in the radial direction are determined by fitting of the positioning projections 9*a* and 9*b* in the positioning holes 3*d* and 3*c*. Also, the upper end of the compression spring 5 (opposite end from the end through which a force for urging the temperature detecting device is applied) is fixed by a fixing member (not shown) to hold the compression spring with a predetermined operating length, thereby determining the position of the temperature detecting device in the thrust direction.

The center of the spring 5 is aligned with the center of the positioning hole 3*d* by the spring receiving surface 3*b* for the purpose of preventing the temperature detecting device from being stopped at an intermediate position without moving to the predetermined lowest position when the force of static friction between the positioning hole 3*d* and the positioning projection 9*a* and the urging force of the spring balance with each other. Thus, the point to which the urging force of the spring is applied and the point at which static friction is produced between the hole and the projection are set so as to be identical with each other to prevent occurrence of such failure as effectively as possible.

In the first embodiment of the present invention, as shown in FIGS. 1A to 1C, the temperature detecting device is directly urged from the rear side by the compression spring 5 aligned with the positioning hole 3*d* in a center, thereby stabilizing the contact pressure between the temperature detecting element 1 and the heater 8.

The positioning holes 3*d* and 3*c* are formed just in the temperature detecting element holding member 3 unlike those in the conventional arrangement in which the temperature detecting element holding member and the positioning member are connected to each other by plate springs. Therefore the accuracy in positioning of the heater 8 and the temperature detecting element holding member 3 can be improved.

Consequently, the accuracy of temperature detection can be improved in comparison with that in the conventional arrangement.

Also, because the positioning accuracy is improved, the area of the non-contact surface of the heater 8 in the through hole 9*c* can be reduced relative to that in the conventional arrangement, so that the possibility of occurrence of damage to the heater caused by nonuniformity of fixation heating or thermal stress.

In this embodiment, the positioning holes and the positioning projections are provided as positioning portions on the temperature detecting element holding member 3 side and on the heater holding member 9 side, respectively. Needless to say, the arrangement may alternatively be such that positioning projections are provided on the temperature detecting element holding member 3 side, while positioning holes are provided on the heater holding member 9 side.

This embodiment has been described with respect to a case where one temperature detecting device is provided for one heat fixing device. However, the present invention can also be applied to a heat fixing device of such a type that two or more temperature detecting devices are provided for one heat fixing device, and temperature adjustment control is performed by detecting the temperatures of different portions with the temperature detecting devices. Also in such a case, the present invention is effective in stabilizing the accuracy of temperature detection at each portion.

In a case where two or more temperature detecting devices are provided, at least one of the temperature detecting devices is arranged in accordance with the present invention if a particularly high accuracy is required or a size restriction is imposed with respect to the place where the temperature detecting device is provided, while the temperature detecting devices in other places are of the conventional type. Also in this case, the present invention is effective in improving the heat fixing device as a whole.

The degree of symmetry of spring placement and the number of springs can be freely selected if sufficiently high uniformity of detection accuracy is ensured.

Second Embodiment

Figure 2:
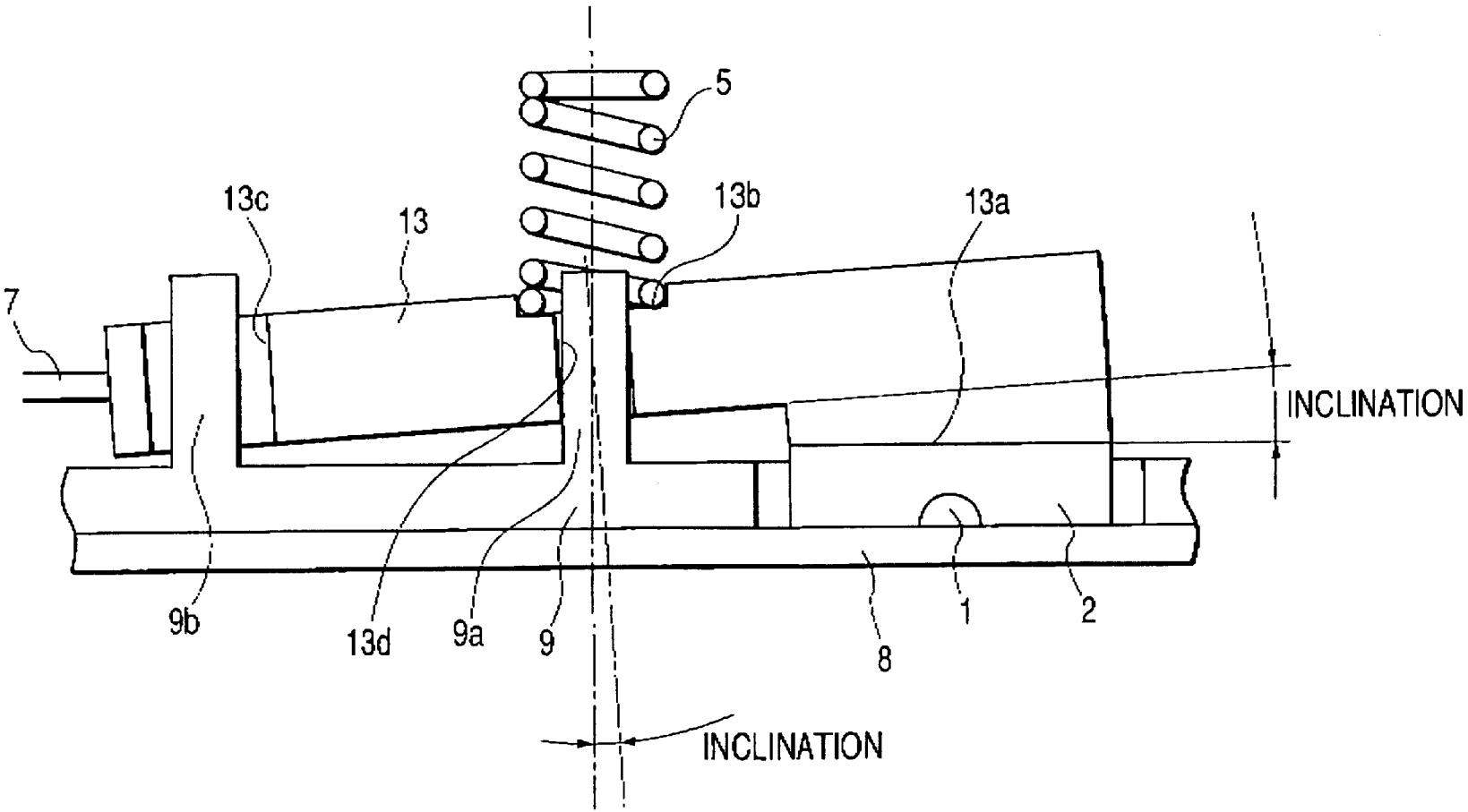
FIG. 2 is a cross-sectional view of a temperature detecting device for a heat fixing device in a second embodiment of the present invention.

FIG. 2 shows a second embodiment of the present invention.

FIG. 2 is a cross-sectional view of a heat fixing device in which a temperature detecting device is attached to a heater holding member 9. In FIG. 2 are illustrated, as components corresponding to those shown in FIGS. 1A to 1C, a temperature detecting element 1, a heat-resistant elastic member 2, a temperature detecting element holding member 13, a temperature detecting element holding surface 13*a*, a spring receiving surface 13*b*, positioning holes 13*c* and 13*d*, a compression spring 5, a harness 7, a heater 8, a heater holding member 9, and projections 9*a* and 9*b* for positioning the temperature detecting element holding portion.

In this embodiment, the positions of the positioning projections of the temperature detecting device in the radial direction are determined by fitting the projections in the positioning holes, and the position of the temperature detecting device in the thrust direction is determined by fixing the upper end of the compression spring (opposite end to the end through which a force for urging the temperature detecting device is applied) by a fixing member (not shown) so as to hold the compression spring with a predetermined operating length. Thus, the temperature detecting device in this embodiment is structured in the same manner as that in the first embodiment.

In this embodiment, the temperature detecting element holding surface 13*a* is inclined relative to the main portion of the holding member 13, and inclination thereof is determined by factoring in a clearance between the positioning hole 13*d* and the positioning projection 9*a*. An averaged median of this inclination may be calculated by setting a size tolerance while considering variations of the hole and the projection in manufacture of the hole and the projection. It is also possible to factor this inclination as a design mean value in the temperature detecting element holding member.

In the second embodiment of the present invention, as shown in FIG. 2, the temperature detecting element holding surface is inclined relative to the main portion of the holding member 13 by an amount determined by factoring in a clearance necessary in manufacture and assembly of the temperature detecting device. This arrangement is effective in stabilizing the contact pressure between the temperature detecting element and the heater. Consequently, the temperature detection accuracy can be further improved in comparison with the first embodiment.

Third Embodiment

Figure 3A:
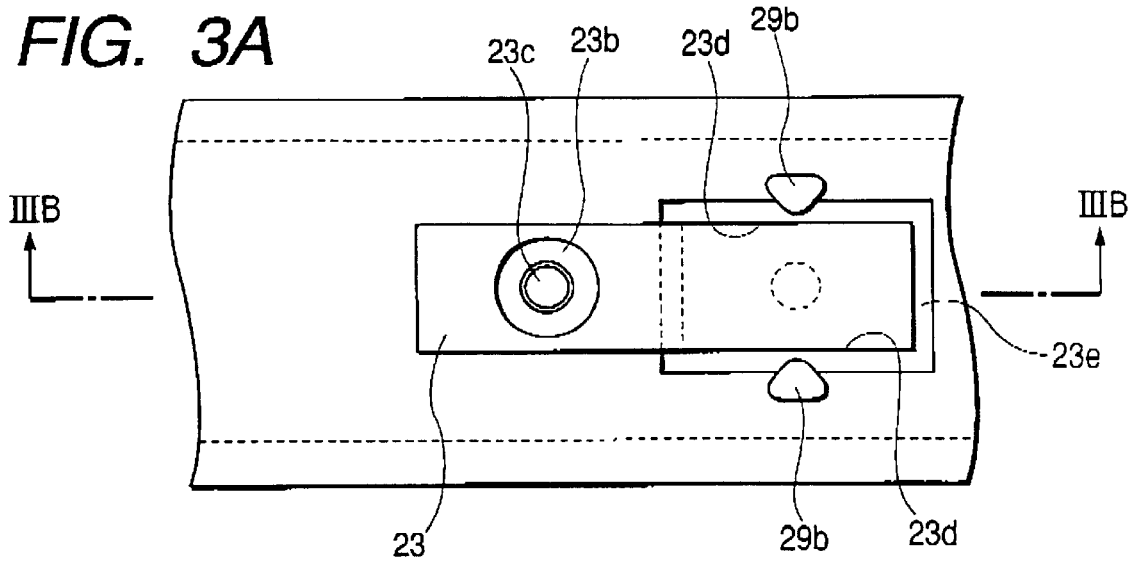
FIGS. 3A, 3B, and 3C show a temperature detecting device for a heat fixing device in a third embodiment of the present invention.
Figure 3B:
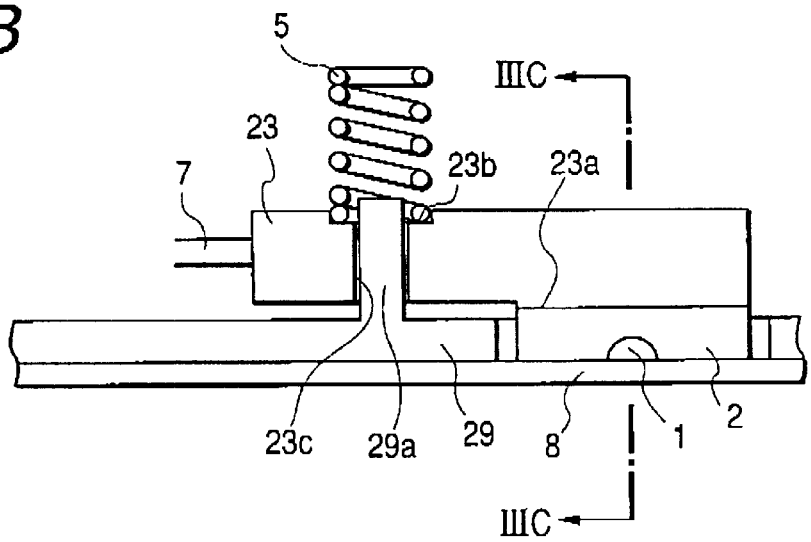
Figure 3C:
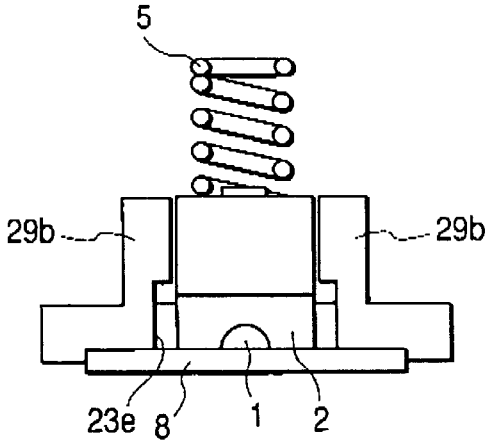

FIGS. 3A, 3B, and 3C show a third embodiment of the present invention.

FIGS. 3A, 3B, and 3C are diagrams showing a heat fixing device in which a temperature detecting device is attached to a heater holding member. FIG. 3A is a plan view, FIG. 3B is a cross-sectional view taken along the line IIIB—IIIB of FIG. 3A, and FIG. 3C is a cross-sectional view taken along the line IIIC—IIIC of FIG. 3B. In FIG. 3B illustrated are a temperature detecting element 1, a heat-resistant elastic member 2, a temperature detecting element holding member 23, a temperature detecting element holding surface 23*a*, a spring receiving surface 23*b*, a positioning hole 23*c*, a peripheral portion 23*d* which serves as a positioning surface, a compression spring 5, a harness 7, a heater 8, a heater holding member 29, a positioning projection 29*a* for positioning the temperature detecting device holding member, and positioning studs 29*b* for positioning the temperature detecting element holding member 23 by being brought into contact with the peripheral portion of the temperature detecting element holding member 23. It is noted that the compression spring 5 is not shown in the plan view of FIG. 3A.

The positions of the positioning projections of the temperature detecting device in the radial direction are determined by fitting the projections in the positioning holes, and the position of the temperature detecting device in the thrust direction is determined by fixing the upper end of the compression spring 5 (opposite end to the end through which a force for urging the temperature detecting device is applied) by a fixing member (not shown) so as to hold the compression spring 5 with a predetermined operating length. Thus, the temperature detecting device is structured in the same manner as that in the first or second embodiments Some conductor layout between the temperature detecting element 1 and the harness 7 makes it impossible to provide positioning holes such as those in the first or second embodiment. In such a case, an arrangement for positioning using a peripheral portion as in this embodiment may be adopted.

In the third embodiment of the present invention, as shown in FIGS. 3A to 3C, the arrangement for positioning using a peripheral portion of the temperature detecting device without using positioning holes is as effective as that in the first or second embodiment.

Fourth Embodiment

Then a fourth embodiment of the present invention will be described.

Figure 10A:
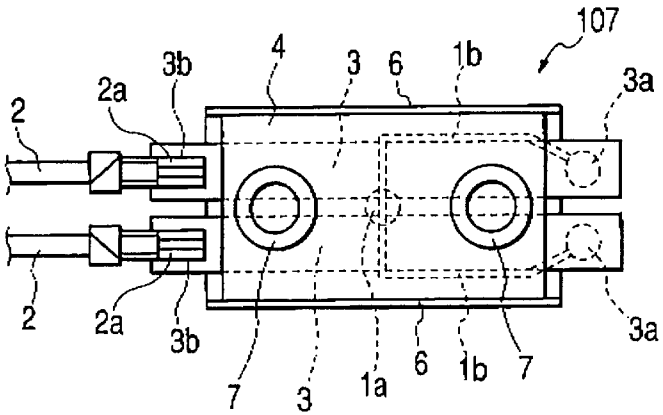
FIGS. 10A, 10B, and 10C are diagrams showing a fourth embodiment of the present invention.
Figure 10B:
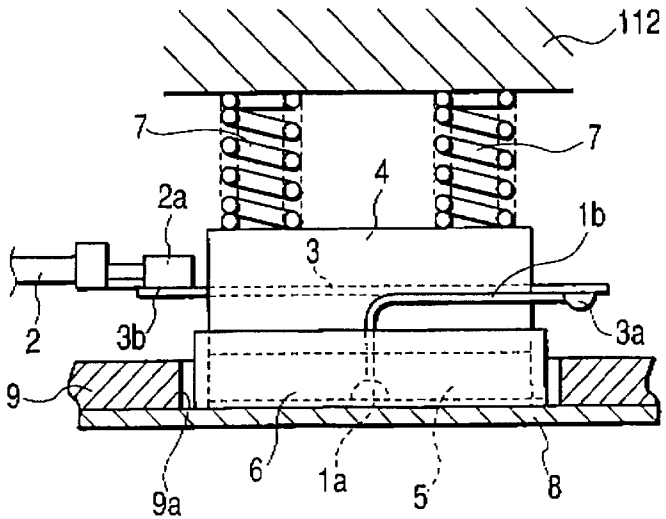
Figure 10C:
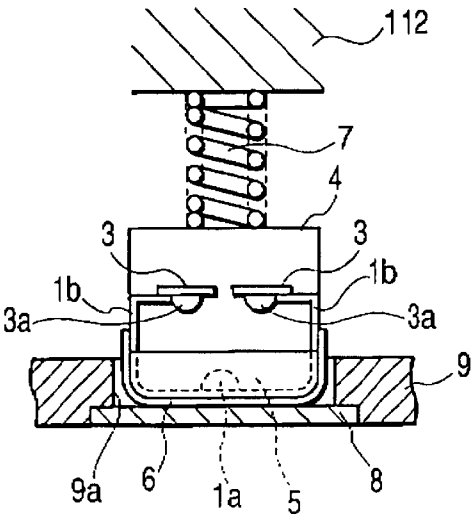

FIGS. 10A, 10B, and 10C are diagrams showing temperature detecting means 107 in this embodiment. FIG. 10A is a plan view, and FIGS. 10B and 10C are a front view and a side view, respectively, in a state where the temperature detecting means 107 is placed on a heater holding member.

The temperature detecting means includes a temperature detecting element (e.g., a thermistor) 1*a*, leads 1*b* for supplying a current to the temperature detecting element 1*a*, jacketed leads 2, metallic terminals 2*a* attached in a caulking manner to one ends of the jacketed leads 2, first and second conductors 3, first welded portions 3*a* of the conductors 3 welded to the leads 1*b* from the temperature detecting element, second welded portions 3*b* of the conductors 3 welded to the metallic terminals 2*a* attached in a caulking manner to the jacketed leads 2, a temperature detecting means main body 4 formed of a heat-resistant resin by insert molding of the first and second conductors 3, a heat-resistant elastic member 5, and a heat-resistant cladding 6 provided for the purpose of ensuring an electrical withstand voltage and protecting the temperature detecting element.

The heat-resistant elastic member 5 is placed along a lower surface of the temperature detecting means main body 4. The temperature detecting element 1*a* is positioned substantially at a center of the lower surface of the heat-resistant elastic member 5. The heat-resistant cladding 6 is formed so as to cover the entire lower surface of the heat-resistant elastic member 5 along which the temperature detecting element 1*a* is placed. That is, the heat-resistant elastic member 5 is provided between the temperature detecting element la and the temperature detecting means main body 4, and the heat-resistant cladding 6 protects the temperature detecting element la and the heat-resistant elastic member 5

In the temperature detecting means 107, the temperature detecting element 1*a* and the jacketed leads 2 are electrically connected to each other through the leads 1*b* of the temperature detecting element 1*a*, the first welded portions 3*a* of the conductors 3, the conductors 3, the second welded portions 3*b* of the conductors 3, and the metallic terminals 2*a* attached in a caulking manner to the jacketed leads 2.

The temperature detecting means 107 is placed along the inner surface of a heater holding member 9, the temperature detecting means main body 4 being positioned in correspondence with a through hole 9*a* of the heater holding member 9, with the lower surface of the main body 4 (in which the temperature detecting element 1*a* is provided) facing downward. Also, springs 7 are provided in a compressed state between the upper surface of the temperature detecting means main body 4 and a fixing member 112 positioned above the temperature detecting means main body 4. The temperature detecting means main body 4 is thereby pressed against the back surface of the heater 8 to be maintained in contact with the same in the through hole 9*a* of the heater holding member 9. Two springs 7 are placed so as to be substantially symmetrical about the temperature detecting element 1*a*. This placement is intended to uniformize the pressure balance of contact pressure between the surface of the temperature detecting means main body 4 and the back surface of the heater 8 contacting each other.

The jacketed leads 2 are connected to a temperature control circuit (CPU) 110 as shown in FIG. 5. The above-described temperature detecting means 107 detects the temperature of the heater 8 as an amount of electricity by the temperature detecting element 1*a* and feeds back the amount of electricity to the temperature control circuit 110. The temperature control circuit 110 controls the electric power supplied to the heater 8 according to the amount of electricity fed back as temperature detection information so that the temperature of the heater 8 is maintained at a predetermined point, thus controlling the temperature of the heater 8.

Figure 9:
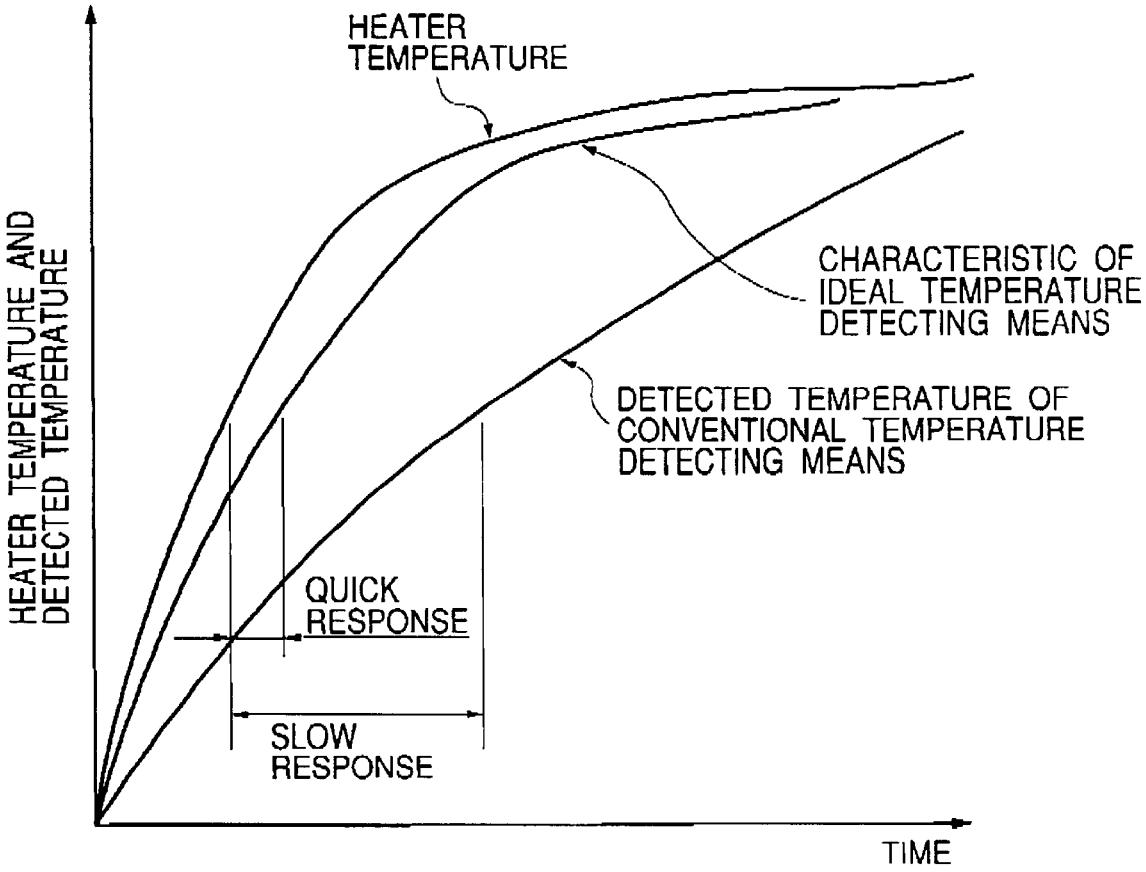
FIG. 9 is a diagram showing a characteristic of a response speed of the temperature detecting device.

The portions of the conductors 3 of the temperature detecting means 107 other than the first and second welded portions 3*a* and 3*b* are entirely covered with an insert molding resin forming the temperature detecting means main body 4. After the insert molding of the conductors 3, in the temperature detecting means 107, the heat-resistant elastic member 5, the temperature detecting element 1*a* and the heat-resistant cladding 6 are attached and welding is performed at portions 3*a* and 3*b*, in the same manner as the conventional temperature detecting means. Insert molding after welding is not suitable in terms of manufacturing procedure since the temperature detecting element is also to be put in an insert molding apparatus. Also, if the conductors are covered with a resin after welding by some means different from insert molding, a complicated process is required because of an increase in the number of process steps for assembly and welding. Therefore, if importance is attached to mass-producibility, at least the welded portions should not be covered with a resin by insert molding. Therefore the temperature detecting means of this embodiment is said to adopt an arrangement in which the portions of the conductors exposed outside are minimized among arrangements conceivable on condition that the manufacturing process is sufficiently simple. Since the conductors 3 are covered with a resin as described above, dissipation of heat to the outside is reduced in comparison with the conventional temperature detecting means. The temperature of the temperature detecting element can therefore be increased rapidly to reduce the time delay in temperature detection, thereby increasing the response speed and enabling the temperature detecting means to have a response characteristic closer to the ideal response characteristic shown in FIG. 9.

The present invention can be advantageously applied to such a heat fixing device that one temperature detecting device is provided for one heat fixing device or that two or more temperature detecting devices are provided for one heat fixing device and temperature adjustment control is performed by detecting the temperatures of different portions with the temperature detecting devices, because the present invention is effective in stabilizing the accuracy of temperature detection at each portion. In a case where two or more temperature detecting devices are provided, at least one of the temperature detecting devices is arranged in accordance with the present invention if a particularly high accuracy is required or a size restriction is imposed with respect to the place where the temperature detecting device is provided, while the temperature detecting devices in other places are of the conventional type. Also in this case, the present invention is effective in improving the heat fixing device as a whole. Also, the kind, placement and the number of springs can be freely selected if sufficiently high uniformity of pressure balance is ensured.

In this embodiment, insert molding is performed so as to cover the portions of the conductors 3 other than the welded portions 3*a* and 3*b* with resin so that dissipation of heat is minimized, thus realizing a temperature detecting means in which the temperature of the temperature detecting element 1*a* can be rapidly Increased, and which has improved temperature detection response. It is therefore possible to stabilize fixation and to reduce electric power consumption in the heat fixing device or the image forming apparatus as well as to improve the reliability of the heat fixing device or the image forming apparatus.

Fifth Embodiment

Figure 11A:
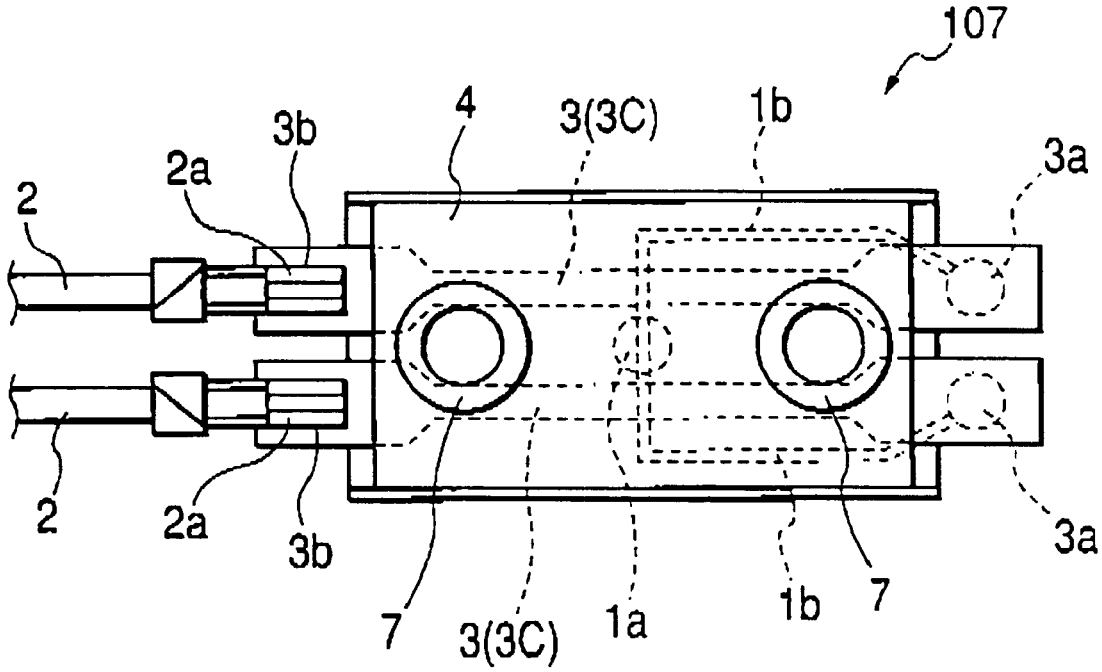
FIGS. 11A and 11B are diagrams showing a fifth embodiment of the present invention.

FIG. 11A is a plan view of temperature detecting means 107 in a fifth embodiment of the present invention. Temperature detecting means 107 in this embodiment is arranged in the same manner as that in the first embodiment except that shapes of the first and second conductors 3 are different.

Figure 11B:
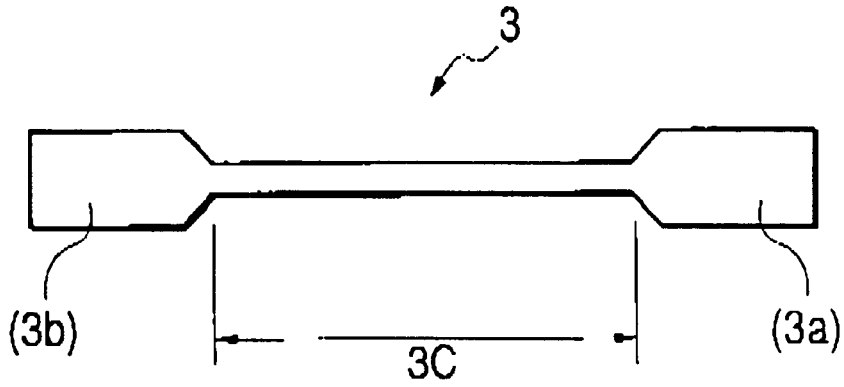

FIG. 11B is a plan view of the conductor 3 alone. This conductor 3 differs from that of the temperature detecting means in the first embodiment in that this conductor 3 has constricted portions 3*c* provided at a center at which the temperature detecting element 1*a* is positioned and provided between the welded portions 3*a* and 3*b* positioned at the both ends, the constricted portions 3*c* being reduced in width relative to the other portions. The constricted portions 3*c* corresponds to the portion inserted by insert molding in the resin forming the temperature detecting means main body 4.

That is, the welded portions 3*a* and 3*b* need a width equal to or larger than a certain value to maintain a strength required for the welded portions 3*a* and 3*b* of the conductor 3 in a welding step. On the other hand, the portion 3*c* inserted in the resin by insert molding is reinforced to a certain extent by the resin after molding and it is, therefore, sufficient for the portion 3*c* to have rigidity enough to be set in the insert molding apparatus without being deformed as a component. For this reason, the conductor 3 can be designed so that the portion 3*c* is substantially smaller in width than the welded portions.

In the temperature detecting means 107 of this embodiment, constricted portions 3*c* are provided in the conductor 3 at the center corresponding to the temperature detecting element and between the welded portions 3*a* and 3*b*, which are exclusively exposed outside, thereby reducing transmission of heat to the welded portions 3*a* and 3*b* as effectively as possible to limit dissipation of heat and to reduce the heat capacity. In this manner, high-speed response with a reduced time delay in temperature detection can be achieved such that the response characteristic of the temperature detecting means becomes closer to the ideal response characteristic thereof shown in FIG. 9.

In this embodiment, the conductor 3 is formed so as to have constricted portions 3*c* reduced in width relative to other portions in the portion inserted in a resin by insert molding which is performed so as to cover the portions other than the welded portions 3*a* and 3*b* of conductor 3, thereby minimizing heat conduction to the welded portions 3*a* and 3*b* and the heat capacity as well as achieving the same effect as that of the fourth embodiment. A temperature detecting means can be realized thereby in which the temperature of the temperature detecting element 1*a* can be rapidly increased, and which has improved temperature detection response. It is therefore possible to stabilize fixation and to reduce electric power consumption in the heat fixing device or the image forming apparatus as well as to improve the reliability of the heat fixing device or the image forming apparatus.

Sixth Embodiment

Figure 12A:
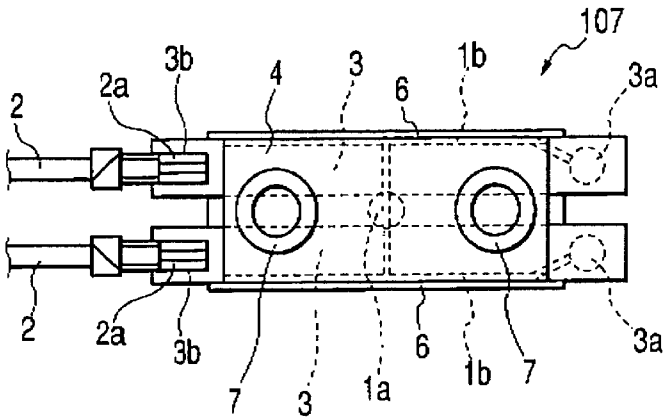
FIGS. 12A 12B, and 12C are diagrams showing a sixth embodiment of the present invention.
Figure 12B:
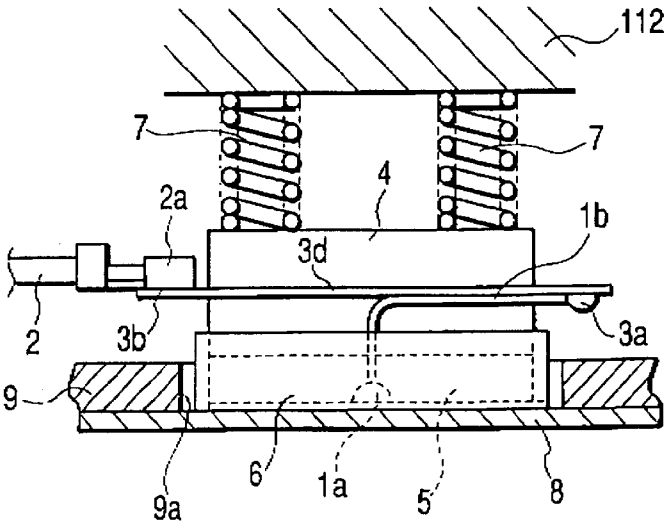
Figure 12C:
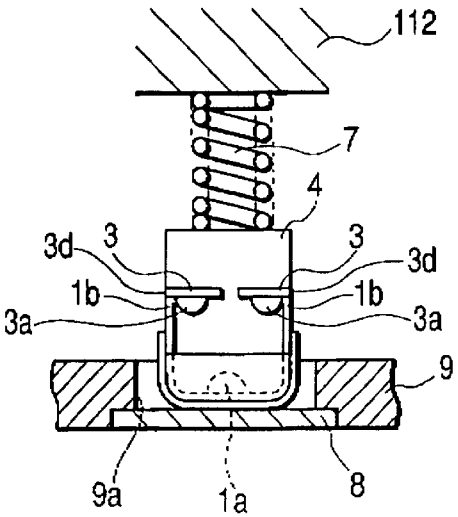

FIGS. 12A, 12B, and 12C are diagrams showing temperature detection means 107 in a sixth embodiment of the present invention. FIG. 12A is a plan view, and FIGS. 12B and 12C are a front view and a side view, respectively, of a state where the temperature detection means 107 is placed on a heater holding member.

The temperature detecting means 107 differs from that in the fourth embodiment in that, as shown in FIGS. 12A, 12B, and 12C, side surfaces 3*d* of the first and second conductors 3 are exposed outside in addition to the welded portions 3*a* and 3*b* of the first and second conductors 3, which are inevitably exposed for a manufacturing purpose.

A thin plate having thickness of 0.4 mm or less is ordinarily used to form the conductors 3. Therefore the amount of heat dissipation through the conductors 3 is not abruptly increased even if the side surfaces 3*d* are exposed. The overall size of the temperature detecting means may be reduced by a requisite amount for covering the side surfaces 3*d* with resin to thereby reduce the heat capacity. In some case, the response of the temperature detecting means can be improved in this manner. In such a case, the portions of the conductors 3 other than the welded portions 3*a* and 3*b* and the side surfaces 3*d* are covered with the resin to achieve an adiabatic effect as well as to reduce the size and the heat capacity. In this manner, high-speed response with a reduced time delay in temperature detection can be achieved such that the response characteristic of the temperature detecting means becomes closer to the ideal response characteristic thereof shown in FIG. 9.

In this embodiment, insert molding is performed so that the portions of the conductors 3 other than the welded portions 3*a* and 3*b* and the side surfaces 3*d* are covered with a resin, thereby minimizing heat dissipation and reducing the heat capacity as effectively as possible. A temperature detecting means can be realized thereby in which the temperature of the temperature detecting element 1*a* can be rapidly increased, and which has improved temperature detection response. It is therefore possible to stabilize fixation and to reduce electric power consumption in the heat fixing device or the image forming apparatus as well as to improve the reliability of the heat fixing device or the image forming apparatus.

Needless to say, the temperature detecting means of the present invention can be effectively used as temperature detecting means in other heating systems of heat fixing devices as well as the film heating system of devices described in the embodiments, and as temperature detecting means in various devices other than heat fixing devices.

What is claimed is:

1. An image heating apparatus comprising:

a heater;

a heater supporting member for supporting said heater;

a temperature detecting element for detecting a temperature of said heater;

a temperature detecting element supporting member for supporting said temperature detecting element; and a spiral shaped spring for biasing said temperature detecting element supporting member toward said heater, said spring biasing a surface of said temperature detecting element supporting member opposite to a surface in which said temperature detecting element is provided, wherein said heater supporting member has a projection entering a space inside said spring.

2. An image heating apparatus according to claim 1, wherein said temperature detecting element is attached to an elastic member, and said supporting member supports said temperature detecting element through said elastic member.

3. An image heating apparatus according to claim 1, wherein said temperature detecting element supporting member is inclined relative to said heater.

4. An image heating apparatus according to claim 1, wherein said spring is provided in each of two positions along a lengthwise direction of said heater.

5. An image heating apparatus comprising:

a heater;

a heater supporting member for supporting said heater, said heater supporting member being elongated along a lengthwise direction of said heater;

a temperature detecting element for detecting a temperature of said heater;

a temperature detecting element supporting member for supporting said temperature detecting element; and a biasing member for biasing said temperature detecting element supporting member toward said heater, said biasing member biasing a surface of said temperature detecting element supporting member opposite to a surface in which said temperature detecting element is provided, wherein in the lengthwise direction of said heater; a biasing position of said biasing member is substantially the same as a position for positioning said temperature detecting element supporting member and said heater supporting member in the lengthwise direction.

6. An image heating apparatus according to claim 5, wherein in the lengthwise direction of said heater, the biasing position is different from a position for positioning said temperature detecting element supporting member and said heater supporting member in a direction perpendicular to the lengthwise direction.

7. An image heating apparatus according to claim 6, wherein in the lengthwise direction of said heater, the position for positioning said temperature detecting element supporting member and said heater supporting member in the direction perpendicular to the lengthwise direction is substantially the same as a position of said temperature detecting element on said heater.

8. An image heating apparatus comprising:

a heater;

a temperature detecting element for detecting a temperature of said heater;

a temperature detecting element supporting member for supporting said temperature detecting element; and a biasing member for biasing said temperature detecting element supporting member toward said heater, wherein said temperature detecting element supporting member has first and second conductors of which first ends are connected to lead portions of said temperature detecting element and of which second ends opposite to the first ends are connected to jacketed leads, and a majority of portions of said first and second conductors except for the first ends and the second ends are covered by a resinous main body of said temperature detecting element supporting member.

9. An image heating apparatus according to claim 8, wherein portions, covered by said main body, of said first and second conductors are provided with constricted portions.

10. An image heating apparatus comprising:

a heater;

a temperature detecting element for detecting a temperature of said heater;

a temperature detecting element supporting member for supporting said temperature detecting element; and a biasing member for biasing said temperature detecting element supporting member toward said heater, wherein said temperature detecting element supporting member has first and second conductors of which first ends are connected to lead portions of said temperature detecting element and of which second ends opposite to the first ends are connected to jacketed leads, and a majority of portions of said first and second conductors except for the first ends, the second ends, and side surfaces are covered by a resinous main body of said temperature detecting element supporting member.

* * * * *

UNITED STATES PATENT AND TRADEMARK OFFICE

CERTIFICATE OF CORRECTION

PATENT NO. : 6,608,976 B2
DATED : August 19, 2003
INVENTOR(S) : Hitoshi Nishitani et al.

It is certified that error appears in the above-identified patent and that said Letters Patent is hereby corrected as shown below:

Column 3,
Line 30, “a” should read -- an --.

Column 5,
Line 50, “downward” should read -- downward. --.

Column 6,
Line 11, “la” should read -- 1a --.

Column 7,
Line 39, “1A.” should read -- 1A, --.
Line 45, “1A:” should read -- 1A; --.
Line 64, “applied:” should read -- applied; --.

Column 8,
Line 3, “state:” should read -- state; --.
Line 5, “6A:” should read -- 6A; --.
Line 17, “invention ;” should read -- invention; --.
Line 20, “12A” should read -- 12A, --.
Line 21, “invention,” should read -- invention. --.

Column 11,
Line 20, “embodiments” should read -- embodiment --.
Lines 65 and 67, “la” should read -- 1a --.

UNITED STATES PATENT AND TRADEMARK OFFICE

CERTIFICATE OF CORRECTION

PATENT NO. : 6,608,976 B2
DATED : August 19, 2003
INVENTOR(S) : Hitoshi Nishitani et al.

It is certified that error appears in the above-identified patent and that said Letters Patent is hereby corrected as shown below:

Column 13,
Line 30, "Increased," should read -- increased, --.
Line 48, "at the" should read -- at --.

Signed and Sealed this

Thirteenth Day of January, 2004

JON W. DUDAS
*Acting Director of the United States Patent and Trademark Office*